US005117631A

United States Patent [19]

Moser

[11] Patent Number: 5,117,631

[45] Date of Patent: Jun. 2, 1992

[54] METHOD AND APPARATUS FOR LAMBDA CONTROL

[75] Inventor: Winfried Moser, Ludwigsburg, Fed. Rep. of Germany

[73] Assignee: Robert Bosch GmbH, Stuttgart, Fed. Rep. of Germany

[21] Appl. No.: 602,304

[22] PCT Filed: May 10, 1989

[86] PCT No.: PCT/DE89/00292

§ 371 Date: Nov. 14, 1990

§ 102(e) Date: Nov. 14, 1990

[87] PCT Pub. No.: WO89/11030

PCT Pub. Date: Nov. 16, 1989

[30] Foreign Application Priority Data

May 14, 1988 [DE] Fed. Rep. of Germany ..... 3816558

[51] Int. Cl.[5] ..... F01N 3/20

[52] U.S. Cl. ..... 60/274; 60/276; 60/285; 123/674; 123/691

[58] Field of Search ..... 60/274, 276, 285; 123/440, 489

[56] References Cited

U.S. PATENT DOCUMENTS 4,112,880 9/1978 Asano ..... 60/276
4,300,507 11/1981 Reddy ..... 60/276
4,739,614 4/1988 Katsuno ..... 60/276
4,840,027 6/1989 Okumura ..... 60/276

FOREIGN PATENT DOCUMENTS 3224347 8/1983 Fed. Rep. of Germany .
53661 3/1983 Japan .

*Primary Examiner*—Douglas Hart
*Attorney, Agent, or Firm*—Walter Ottesen

[57] ABSTRACT

In a method for lambda control, the lambda controller actual value for forming a control deviation is not only measured by a lambda probe having a jump response but in addition, the averaged lambda value is used as a lambda measurement actual lvalue which is compared to a lambda measurement desired value. The lambda measurement desired value is fixed in advance for different values of operating variables such that it corresponds to that lambda value for every operating condition for which an optimal toxic substance conversion results. If the lambda measurement actual value deviates from a pregiven value, then at least one control parameter for the two-position control is so changed that the desired value self adjusts thereafter. This method and an apparatus operating pursuant thereto permit the two-position control to be so controlled with respect to its characteristics in all operating conditions that the particular desired mean lambda value self adjusts for optimal toxic substance conversion.

12 Claims, 2 Drawing Sheets

METHOD AND APPARATUS FOR LAMBDA CONTROL

FIELD OF THE INVENTION

The invention relates to a method and an apparatus for adjusting the lambda value for the air/fuel mixture to be metered to an internal combustion engine.

BACKGROUND OF THE INVENTION

The lambda value of a fuel mixture is controlled in order to adjust optimal converting conditions for a catalyzer which is mounted in the exhaust channel of an internal combustion engine. The conversion takes place only in a narrow range of lambda values. Where the center of the range best lies is dependent upon the particular operating condition. This is the case because for different operation conditions, the different toxic substances, that is carbon monoxide, carbon dioxide and nitrogen oxide, occur in different concentrations and because the conventional catalyzers best convert these toxic substances at different lambda values into non-toxic gases. Accordingly, nitrogen oxide is optimally converted at lambda values which are richer than the stoichiometric value; whereas, carbon monoxide and hydrocarbons are better converted in the lean region. Catalyzers are primarily operated in the slightly rich region since the elimination of nitrogen oxide is the primary aim.

The concentration of carbon monoxide is based essentially on heterogeneous mixture distributions and on fluctuations of the mixture composition from cycle to cycle. The mentioned effects influence also the emission of hydrocarbons which, in addition, is greatly dependent upon the combustion temperature and increases with falling combustion temperature. In contrast, the emission of nitrogen oxides decreases with decreasing combustion temperature. The mixture distribution and fluctuations thereof as well as the particular combustion temperature are dependent upon the engine speed and the load. The different composition of toxic substances with different operating conditions requires the adjustment of different lambda values for the different operating conditions.

Different lambda values can be adjusted in that at least one control parameter of the means used for two-level control is changed. This measure is described in DE 25 45 759 Al (U.S. Pat. No. 4,210,106). For practical applications, for example, an extended integration time in the direction rich is stored in a characteristic or in a characteristic field addressable via values of operating variables.

German published patent application DE-OS 32 24 347 discloses an arrangement for reducing the exhaust gas toxic components of an internal combustion engine having an oxygen probe upstream and downstream of the catalyzer. The probe arranged downstream functions as the guide probe to effect a follow-up control of a mean lambda value when there is a deviation from the optimal composition of the air/fuel ratio. This is obtained by modifying the control parameter.

It has been shown that by taking the described action in practice, it is not always possible to precisely adjust that mean lambda value which leads to the optimal conversion rate for the different toxic substances for a particular operating condition which is present.

The invention solves the problem of providing a method for controlling the lambda value with which the desired mean lambda value can be adjusted with great precision for all operating conditions. The invention also has the object of providing an apparatus for carrying out a method of this kinds.

SUMMARY OF THE INVENTION

The method of the invention is characterized in that it not only determines the particular immediate lambda actual value by means of which the two-level control takes place; instead, the method additionally uses the mean lambda value as a lambda measuring actual value which is compared to a pregiven lambda measuring desired value to form a measurement deviation on the basis of which at least one control parameter is so changed that a lambda measuring actual value can be adjusted which reduces the above-mentioned measuring deviation. A control parameter is then no longer only determined in the particular operating condition present in dependence upon values of operating variables in order to obtain a specific mean lambda value at which the catalyzer optimally converts; instead, there is an additional monitoring as to whether the desired value is actually reached, and if not, the pregiven control parameter is so changed that the desired lambda measuring actual value can be adjusted for optimal conversion.

The lambda measuring actual value, which is the mean lambda value, can be determined either in that the oscillating lambda value is determined as it is supplied from the lambda probe used for control or, the lambda value downstream of the catalyzer can be measured with a second probe.

The lambda measuring actual value is preferably determined with such a probe when such a probe is available anyhow, for example, in order to monitor the catalyzer activity. If this second probe is not available downstream of the catalyzer, then it is generally more advantageous to form the lambda measuring actual value by averaging the lambda value used for control.

Which of the different control parameters is changed because of the determined measuring deviation is dependent upon the oscillating performance of the controlled overall For example, if the lambda value is to be displaced somewhat further in the direction of rich, then either the additional integrating time is extended or the proportional jump in the direction of rich is increased. The first measure leads to an extension of the oscillating time of the two-level control; whereas the second measure leads to a shortening. The last measure leads to a faster correction of errors but has the disadvantage of tending toward higher oscillation. This makes it clear that the overall response of the controlled system is to be considered when selecting the control parameter to be changed or the control parameters to be changed.

BRIEF DESCRIPTION OF THE DRAWINGS

The invention will be explained with respect to embodiments shown in the figures.

DESCRIPTION OF THE PREFERRED EMBODIMENTS OF THE INVENTION

Before details of the invention are considered, the conditions on which the invention is based will be explained premised on the upper portion of FIG. 4 with the aid of FIGS. 1 to 3.

Figure 4:
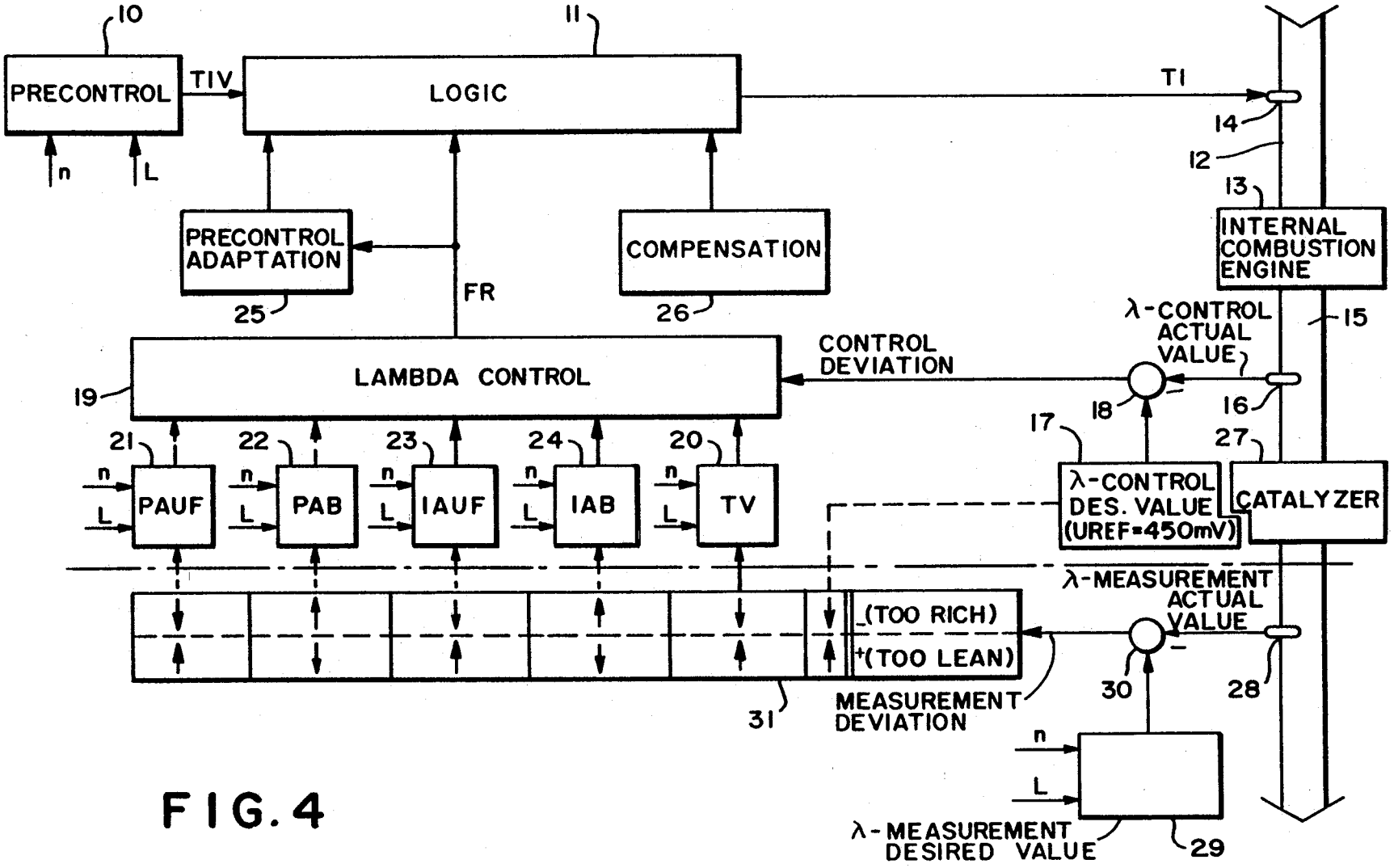
FIG. 4 is a function diagram in the form of a block diagram for explaining a method having control parameters which are changeable based on a measurement deviation and which are formed with aid of a mean lambda value which is measured by a probe downstream of the catalyzer; and, FIG. 5 is a variation of the functional sequence of FIG. 2 by means of which the mean lambda value is obtained by averaging the lambda value which is used for two-step control.

In the lower portion of FIG. 4, a horizontal dot-dash line is drawn. Functions above this line are known from the state of the art; whereas, the functions shown below this line including the influence lines extending into the upper portion are new.

The primary function sequence in FIG. 4 is the following. Preliminary fuel injection times TIV are determined by a precontrol 10 in dependence upon values of the engine speed n and the load L. These fuel injection times TIV are converted into injection times TI by a logic 11 which will be explained below. The injection times TI are supplied to an injection device 14 mounted in the intake pipe 12 of an internal combustion engine 13. The fuel quantity injected into the airflow drawn in by suction produces a specific lambda value which is measured as a lambda control actual value by a lambda probe 16 mounted in the exhaust channel 15 of the internal combustion engine 13. This lambda control actual value is compared to a lambda control desired value which is supplied by a means 17 to a desired value output. FIG. 4 includes a delineation that this value is intended to be a reference voltage UREF of 450 mV. This indicates that lambda values are often not compared to each other in practice but voltages as they are supplied by a lambda probe at a specific lambda value. The comparison between lambda control desired value and lambda control actual value takes place in a comparison step 18 wherein the control deviation is formed as the difference between the above-mentioned values. A lambda control 19 determines a control output in the form of a control factor FR based on the control deviation with which the preliminary injection time TIV is multiplied in the logic 11. If the lambda control actual value remains below the lambda control desired value, this means that the mixture burned in the internal combustion engine 13 is too lean. A control factor FR>1 is supplied whereby a longer actual injection time TI is formed from the preliminary injection time TIV.

Figure 1A:
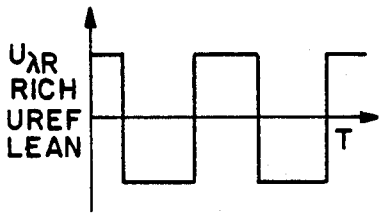
FIG. 1*a* is a diagram of the oscillating lambda value as a function of time for a two-step control and FIG. 1*b* is a time correlated diagram of the waveform of the control output.
Figure 2A:
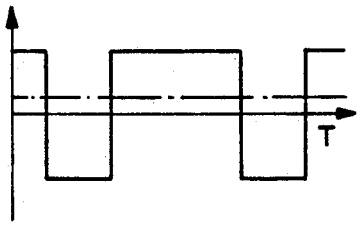
FIG. 2*a* is a diagram corresponding to that of FIG. 1*a* but utilizing an additional integration time for obtaining the control output and FIG. 2*b* is a diagram corresponding to FIG. 1*b;*
Figure 3A:
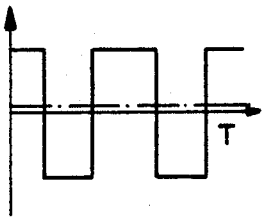
FIG. 3*a* is a diagram corresponding to that of FIG. 1*a* but utilizing a proportional jump to obtain the control output and FIG. 3*b* is a diagram corresponding to FIG. 1*b*.
Figure 1B:
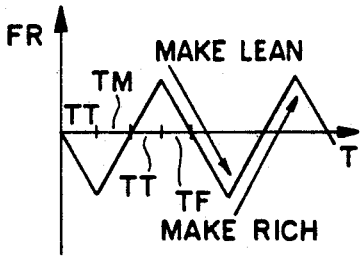
Figure 2B:
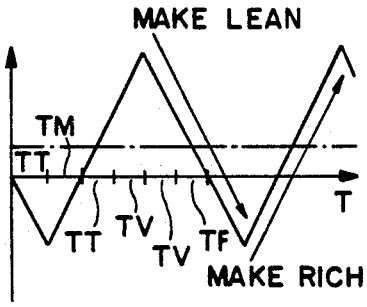
Figure 3B:
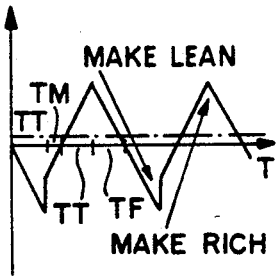

Possible waveforms of the lambda control actual value are shown in FIGS. 1*a*, 2*a* and 3*a* and the corresponding waveforms of the control factors FR are shown in FIGS. 1*b*, 2*b* and 3*b*, respectively.

The explanation of FIG. 1 begins with a time point at which the lambda control actual value (referred to as the probe voltage in the following) decreases from rich toward lean; that is, from a value which indicates a mixture that is richer than a mixture corresponding to that which leads to the reference voltage UREF and to a mixture that is lean. The cross-over of the probe voltage through the reference voltage takes place in a jump-like manner. The same applies for the return jump from lean to rich. In that instant in which the probe voltage crosses over the reference voltage in the jump from rich to lean, the lambda control 19 inverts the integrating direction to obtain the control factor FR from the control deviation so that the control factor is increased from values below 1. The time between the reversal of the integrating direction and reaching the control factor 1 is shown in FIG. 1 and identified with TM. After the value 1 is reached, the integration however proceeds further since the probe voltage still indicates the value lean even through the control factor already leads to a rich mixture on the intake end. This rich mixture is detected by the lambda probe 16 delayed by a dead time TT. After the dead time TT has passed, the probe voltage jumps from lean to rich. This jump causes a renewed reversal of the integrating direction. The control factor FR is now reduced so that the control factor can again reach the value 1 after a time TF has run measured from the jump. A lean mixture is adjusted at the suction end with a further decrease of the control factor FR which, however, again leads to a jump in the measuring signal after the dead time TT has run and this time from rich toward lean. In FIG. 1*b*, and also in FIGS. 2*b* and 3*b*, it is assumed that the integrating time TAUF for the increase integration and the integrating time TAB for the decrease integration are of the same magnitude. Then the time intervals TM+TT as well as TF+TT are the same so that the control factor oscillates symmetrically about the value 1 and the probe voltage oscillates symmetrically about the reference voltage UREF. It is noted that for a reference voltage UREF between approximately 400 mV and 550 mV, as it is used in practice, the control factor does not oscillate symmetrically about the value 1 but symmetrically about a value somewhat less than 1. The mean lambda value then lies slightly in the lean region. The jump response of the probe furthermore leads to a displacement toward lean at which the measurement value with a jump-like change of the mixture from lean to rich jumps more rapidly than with a change in the reverse direction.

The effects mentioned above then lead to a displacement toward lean. However, as mentioned above, in contrast for a lowering of the portion of the nitrogen oxide in the exhaust gas it is desired that on average, a slightly rich lambda value is present. The lambda control 19 must be correspondingly driven. For this purpose, different methods are available of which two are explained with reference to FIGS. 2 and 3.

According to FIG. 2*b* and according to one measure, the integrating direction is not immediately changed from make rich to make lean when the probe voltage jumps from lean to rich; instead, make rich is continued over a time delay TV before the jump in the probe voltage is followed by the jump in the control direction. Between the time point of the jump in the probe voltage and that time point at which the control factor crosses over the value 1, not only does the time TF pass, but the time 2TV+TF. The control factor FR is in the range of values greater than 1 during the time duration TT+2TV+TF. In contrast, the range for values<1 remains unchanged over the time duration TT+TM. The measure leads to an averaged control factor>1 which is illustrated in FIG. 2*b* by a dash-dot line. The mean control factor and therewith the mean lambda value can be displaced to different extents in the direction toward rich by different selection of the time delay TV. The greater the displacement, the greater the period of the control oscillation becomes.

A displacement in the direction to make rich but with a decrease of the period of the control oscillation, can also be obtained by an operation as shown in FIGS. 3*a* and 3*b*. When the probe voltage jumps from rich to lean, the control factor FR is increased in a jump-like manner by a proportional component PAUF before the upward integration begins with the integrating time TAUF. Only a short time TM' passes with the jump-like upward change between the change in the probe voltage from rich to lean and that particular time point at which the control factor FR reaches the value 1 starting from lesser values. Values $<1$ for the control factor FR exist then only during the time duration TT+TM' which is shorter than the time duration TT+TM pursuant to the method of FIG. 1*b*. The time duration TT+TF remains unchanged. The greater the upward jump PAUF, the greater the displacement of the mean control factor to the value $>1$ which leads to an increasingly rich mean lambda value. In contrast, the oscillating period of the two-position control then reduces ever further.

In FIG. 4, and in the portion above the dash-dot line, there is shown how the described realization is utilized in order to adjust a mean lambda value for each operating condition which lambda value leads to an optimal conversion of toxic substance. Means 20 are provided to adjust the time delay TV in dependence upon values of the engine speed n and the load L. In this way, it is possible to change the time delay TV in dependence upon the operating point, that is, to practice the method explained with respect to FIGS. 2*a* and 2*b*.

In addition to means 20 for adjusting the time delay TV, the following are provided in FIG. 4: a means 21 for adjusting the magnitude of the upward jump PAUF, a means 22 for adjusting the magnitude of the downward jump PAB, a means 23 for adjusting the upward integrating time IAUF and a means 24 for adjusting the downward integrating time IAB. Only broken lines are shown to the lambda control 19 from the means 21 and 22 for adjusting the jump variables. This is the case because in practice, these variables are changed only in exceptional cases with the time delay TV. This is dependent upon the oscillation response of he overall controlled system. As explained with reference to FIGS. 2 and 3, the introduction of a time delay leads to an increased oscillating period whereas the introduction of an upward jump leads to a shortening of the oscillating period and, correspondingly, a downward jump leads to a shortening of the oscillating period. As a rule, for a specific type of internal combustion engine, it is only purposeful to use one of the two measures for displacing the mean lambda value in the rich direction. For such a displacement, also different integrating times IAUF and IAB can be used. These integrating times are, however, as a rule changed in dependence upon engine speed in order to hold the amplitude of the control oscillation essentially constant for all operating conditions.

A precontrol adaptation 25 and a compensation 26 are shown in FIG. 4 in addition to the functions previously described. The compensation 26 acts to compensate the influence of measured variables on the injection time, for example, the influence of the battery voltage. In contrast, the precontrol adaptation acts to compensate for disturbing quantities which are not measured such as air pressure fluctuations or temperature fluctuations.

As explained above, for a two-position control, the output control such as the control factor FR, and the lambda value oscillate about the particular mean value. At least one control parameter, the time delay TV in the case of the example, is so changed in dependence upon the particular operating condition that a mean lambda value can be adjusted for optimal conversion of toxic substances. In practice, this is however not always attained and this leads to a poorer quality of the exhaust gas than desired.

An excellent exhaust gas quality for all operating conditions can be obtained with the aid of the following: a lambda measuring probe 28 mounted downstream of the catalyzer 27, a means 29 for supplying measured desired values, a measured value comparison step 30 and a controller adaptation 31. The lambda measured actual value as supplied by the lambda measuring probe 28 is compared in the measured value comparison step 30 to the lambda measuring desired value from means 29 for supplying the measured desired value output to form a measurement deviation. The measurement deviation is supplied to the control adaptation 31. If the measurement deviation is negative, that is the lambda measured actual value is greater than the lambda measured desired value, this is an indication that the mean lambda value as it occurs downstream of the catalyzer 27 is too rich. This means that the time delay TV has to be lowered which is shown in FIG. 4 by means of a downward arrow. This reduction step can be a fixed step width or a step width determined according to pregiven computation method such as a step width proportional to the measuring deviation. Which step width is the most purposeful is to be determined in dependence upon the oscillation response of the overall control system by means of tests.

In FIG. 4, there is not only a solid influence line drawn in from the controller adaptation 31 to the means 20 for adjusting the time delay TV; instead, dotted lines are provided also between the controller adaptation 31 and the means for adjusting the upward jump PAUF, the means 22 to adjust the downward jump PAB, the means 23 for adjusting the upward integrating time IAUF, the means 24 for adjusting the downward integrating time IAB and the means 29 for the measured desired value output. The phantom illustration is provided for different reasons. The line from means 21 for adjusting the upward jump PAUF is broken since the premise is taken in the example that for adjusting the desired mean lambda value, the time delay TV is changed. As explained above, in practice, even with conventional methods for which the change is dependent only upon values of the operating values, typical changes are made on only one of the different control parameters. Correspondingly, when controlling changes according to the invention, only one of the control parameters is influenced.

The integrating times IAUF and IAB are preferably not used for adjusting the desired mean lambda value since these variables, as explained above, are typically changed for adjusting a constant amplitude of the control oscillation for different engine speeds. The overview of the control is made more difficult if these variables are changed in dependence upon different values. When special conditions are present, the change of the integrating times can, however, be especially purposeful also in dependence upon the measured deviation.

Also by displacing the reference voltage for the two-position control, the mean lambda value can be changed. However, only slight displacement possibilities are available because of the jump-response of the lambda probe 16.

Figure 5:
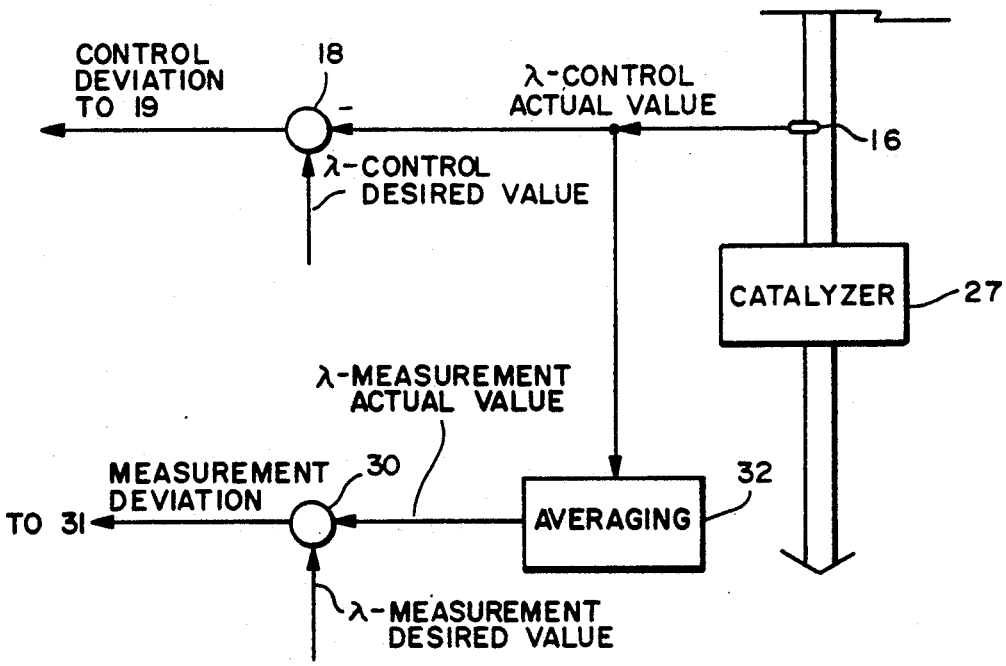

A method according to FIG. 5 is advantageous if a second measuring probe 28 is not to be used for reasons of cost. According to this method, the mean lambda value is not determined by measuring downstream of the catalyzer 27 but the lambda measured actual value is determined by averaging means 32 from the lambda controller actual value of the lambda probe 16 by forming a mean value. The mean value formation takes place for example in that over an entire oscillation of the lambda controller actual value is averaged, that is, for example, from a jump from lean to rich until the next jump from lean to rich. The measured values are advantageously linearized in advance of averaging in correspondence to the non-linear characteristic $U_\lambda = f(\lambda)$.

The means 29 for supplying measured desired values preferably has a memory wherein the lambda measured desired values are stored and are addressable via values of operating variables. The desired values are so determined that they, for the particular operating condition present, correspond to the average lambda value which leads to the optimal toxic substance conversion. Addressing operating variables are preferably the engine speed n and a variable dependent upon load L such as the accelerator pedal position, the throttle flap angle or the air mass drawn in by suction. The desired values can however also be determined on characteristics or by means of computations according to a formula.

All mentioned means, method steps and memories are preferably defined by the hardware and software of a microprocessor which is used typically in vehicle electronics.

I claim:

1. A method for controlling the lambda value of the air/fuel mixture to be metered to an internal combustion engine, the method comprising the steps of:

forming a control deviation by applying the signal of a control lambda probe to a means for two-position control with pregiven control parameters, the control lambda probe having a jump response;

specifying a lambda measurement desired value for the particular operating condition which is present; averaging the measurement lambda actual value for forming a means lambda actual value;

computing the measurement deviation between the lambda measurement desired vale and the means lambda actual value;

changing at least one control parameter in dependence upon the measurement deviation such that a lambda measurement actual value self adjusts which reduces said measurement deviation; and providing a time delay for said control parameter which becomes effective for the two-position control after a reversal of the control deviation with said time delay being formed asymmetrically.

2. The method of claim 1, wherein the mean lambda value is determined by measuring with a measuring lambda probe downstream of a catalyzer.

3. The method of claim 1, wherein the changeable control parameter is changed in steps having a width proportional to the measurement deviation.

4. The method of claim 1, wherein the changeable control parameter is changed in steps having a fixed width.

5. An apparatus for controlling the lambda value of an air/fuel mixture to be metered to an internal combustion engine, the apparatus comprising:

control means for two-position control the pregiven control parameters;

a control lambda probe having a jump response for supplying a signal indicative of a lambda measurement actual value to said control means for forming a control deviation;

said control means including means for determining a lambda measurement desired value for the particular operating condition of the engine;

averaging means for receiving said signal and for averaging the actual values to provide a means lambda measurement actual value;

means for computing the measurement deviation between the lambda measurement desired value and the mean lambda measurement actual value;

means for changing at least one control parameter in dependence upon the measurement deviation so as to cause a lambda measurement actual value to self adjust which reduces the measurement deviation; and, means for forming an asymmetrically configured time delay for said one control parameter with said time delay becoming effective for the two-position control after the control deviation is reversed.

6. The apparatus of claim 5, wherein said means for providing said mean lambda value includes a memory for storing lambda measurement desired values addressable via values of operating variables.

7. An apparatus for controlling the lambda value of an air/fuel mixture to be metered to an internal combustion engine having an exhaust system equipped with a catalyzer, the apparatus comprising:

lambda control means for two-position control with pregiven control parameters;

a first control lambda probe mounted ahead of the catalyzer and having a jump response for supplying a signal indicative of a first lambda measurement actual value;

first desired lambda means for determining a first lambda measurement desired value for the particular operating condition of the engine;

said control means including means for computing the control deviation between the first lambda measurement desired value and the first lambda measurement actual value;

a second control probe mounted downstream of the catalyzer to provide a second lambda measurement actual value;

a second desired lambda means for determining a second lambda measurement desired value dependent upon the engine speed (n) and load (L);

comparison means for comparing said second lambda measurement desired value to said second lambda measurement actual value to provide a measurement deviation;

control adapt ion means receiving said measurement deviation for supplying an output signal indicative of the richness or leanness of said second lambda measurement actual value;

means interposed between said control adaptation means and said lambda control means for changing at least one control parameter in dependence upon the measurement deviation so as to cause a lambda measurement actual value to self adjust which reduces the measurement deviation; and, means for forming an asymmetrically configured time delay for said control parameter with said time delay becoming effective for the two-position control of said lambda control means after the control deviation is reversed.

8. The apparatus of claim 7, wherein said second desired lambda means includes a memory for storing lambda measurement desired values addressable via values of operating variables.

9. An apparatus for controlling lambda value of an air/fuel mixture to be metered to an internal combustion engine having an exhaust system equipped with a catalyzer, the apparatus comprising:

lambda control means for two-position control with pregiven control parameters;

a first control lambda probe mounted ahead of the catalyzer and having a jump response for supplying a signal indicative of a first lambda measurement actual value;

first desired lambda means for determining a first lambda measurement desired value for the particular operating condition of the engine;

said control means including means for computing the control deviation between the first lambda measurement desired value and the first lambda measurement actual value;

a second control probe mounted downstream of the catalyzer to provide a second lambda measurement actual value;

a second desired lambda means for determining a second lambda measurement desired value;

comparison means for comparing said second lambda measurement desired value to said second lambda measurement actual value to provide a measurement deviation;

control adaption means receiving said measurement deviation for supplying an output signal indicative of the richness or leanness of said second lambda measurement actual value;

means interposed between said control adaptation means and said lambda control means for changing at least one control parameter in dependence upon the measurement deviation so as to cause a lambda measurement actual value to self adjust which reduces the measurement deviation; and, said first desired lambda means being connected to said control adaption means so as to permit said measurement deviation supplied by said comparison means to operate on said first desired lambda means via said control adaption means.

10. The apparatus of claim 9, wherein said second desired lambda means determines said second lambda measurement desired value in dependence upon the engine speed (n) and load (L).

11. A method for controlling the lambda value of an air/fuel mixture to be metered to an internal combustion engine having an exhaust system equipped with a catalyzer and lambda control means for two-position control with pregiven control parameters, the method comprising the steps of:

utilizing a first control lambda probe mounted ahead of the catalyzer and having a jump response for supplying a signal indicative of a first lambda measurement actual value;

determining a first lambda measurement desired value for the particular operating condition of the engine;

computing the control deviation between the first lambda measurement desired value and the first lambda measurement actual value;

utilizing a second control lambda probe mounted downstream of the catalyzer to provide a second lambda measurement actual value;

determining a second lambda measurement desired value;

comparing said second lambda measurement desired value to said second lambda measurement actual value to provide a measurement deviation;

utilizing a control adaptation means for supplying an output signal indicative of the richness or leanness of said second lambda measurement actual value;

interposing means between said control adaptation means and said lambda control means for changing at least one control parameter in dependence upon the measurement deviation so as to cause a lambda measurement actual value to self adjust which reduces the measurement deviation; and, connecting said first desired lambda means to said control adaptation means so as to permit said measurement deviation supplied by said comparison means to operate on said first desired lambda means via said control adaption means.

12. The method of claim 11, wherein said second desired lambda means determines said second lambda measurement desired value in dependence upon the engine speed (n) and load (L).

* * * * *

UNITED STATES PATENT AND TRADEMARK OFFICE

CERTIFICATE OF CORRECTION

PATENT NO. : 5,117,631

DATED : June 2, 1992

INVENTOR(S) : Winfried Moser

It is certified that error appears in the above-identified patent and that said Letters Patent is hereby corrected as shown below:

In the title page, in the Abstract, line 5: delete "1value" and substitute -- value -- therefor.

In column 2, line 4: delete "kinds" and substitute -- kind -- therefor.

In column 2, line 44: after "overall", insert -- system. --.

In column 5, line 48: delete "he" and substitute -- the -- therefor.

In column 7, line 51: delete "means" and substitute -- mean -- therefor.

In column 7, line 53: delete "vale" and substitute -- value -- therefor.

In column 7, line 53: delete "means" and substitute -- mean -- therefor.

In column 7, line 58: after "and", insert -- , --.

In column 2, line 45, beginning with "For example" should be part of previous paragraph.

UNITED STATES PATENT AND TRADEMARK OFFICE

CERTIFICATE OF CORRECTION

PATENT NO. : 5,117,631

DATED : June 2, 1992

INVENTOR(S) : Winfried Moser

It is certified that error appears in the above-identified patent and that said Letters Patent is hereby corrected as shown below:

In column 8, line 7: delete "the" and substitute -- with -- therefor.

In column 8, line 17: delete "means" and substitute -- mean -- therefor.

In column 8, line 52: between "control" and "probe", insert -- lambda --.

In column 8, line 62: delete "adapt ion" and substitute -- adaptation -- therefor.

In column 9, line 13: between "controlling" and "lambda", insert -- the --.

In column 9, line 30: between "control" and "probe", insert -- lambda --.

In column 9, line 39: delete "adaption" and substitute -- adaptation -- therefor.

UNITED STATES PATENT AND TRADEMARK OFFICE

CERTIFICATE OF CORRECTION

PATENT NO. : 5,117,631

DATED : June 2, 1992

INVENTOR(S) : Winfried Moser

It is certified that error appears in the above-identified patent and that said Letters Patent is hereby corrected as shown below:

In column 9, line 50: delete "adaption" and substitute -- adaptation -- therefor.

In column 10, line 3: delete "adaption" and substitute -- adaptation -- therefor.

In column 10, line 45: delete "adaption" and substitute -- adaptation -- therefor.

Signed and Sealed this

Ninth Day of November, 1993

*Attest:*

*Attesting Officer*

BRUCE LEHMAN

*Commissioner of Patents and Trademarks*